United States Patent [19]

Longo et al.

[11] 4,130,492

[45] Dec. 19, 1978

[54] $MXY_3$ SOLID LUBRICANTS

[75] Inventors: John M. Longo, New Providence; John J. Steger, Scotch Plains, both of N.J.

[73] Assignee: Exxon Research & Engineering Co., Florham Park, N.J.

[21] Appl. No.: 891,749

[22] Filed: Mar. 30, 1978

Related U.S. Application Data

[63] Continuation-in-part of Ser. No. 870,033, Jan. 16, 1978, abandoned which is a continuation of Ser. No. 788,686, Apr. 18, 1977, abandoned.

[51] Int. Cl.[2] ..... C10M 3/18; C10M 5/14; C10M 7/20; C10M 7/24

[52] U.S. Cl. ..... 252/18; 252/25

[58] Field of Search ..... 252/25, 18

[56] References Cited

U.S. PATENT DOCUMENTS

| | | | |
|---|---|---|---|
| 2,421,543 | 6/1947 | Cook | 252/25 |
| 2,977,302 | 3/1961 | Spengler | 252/25 |
| 3,377,277 | 4/1968 | Sonlen | 252/25 |
| 3,851,045 | 11/1974 | Donohue | 252/25 |

OTHER PUBLICATIONS

Mat. Res. Bull, vol. 11, pp. 657–662, 1976, Pergamon Press, Inc.

*Primary Examiner*—Irving Vaughn
*Attorney, Agent, or Firm*—Joseph J. Allocca

[57] ABSTRACT

Materials of the general formula $MXY_3$ wherein M is selected from the group consisting of Mg, V, Mn, Fe, Co, Ni, Zn, Cd, Sn, Pb and mixtures thereof; X is a pnictide selected from the group consisting of phosphorus, arsenic, antimony, and mixtures thereof, and Y is a chalcogenide selected from the group consisting of sulfur, selenium and mixtures thereof, have been discovered to be superior lubricants exhibiting resistance to oxidation and thermal degradation, low friction, excellent antiwear activity and long effective life. Metal surfaces coated with such materials resist gauling and damage due to adhesive or corrosive wear. These materials can be used as dry solid lubricants or as additives to oils and greases.

37 Claims, 5 Drawing Figures

FIGURE I
$ZnPS_3$ IS MORE STABLE TO OXIDATION THAN $MoS_2$
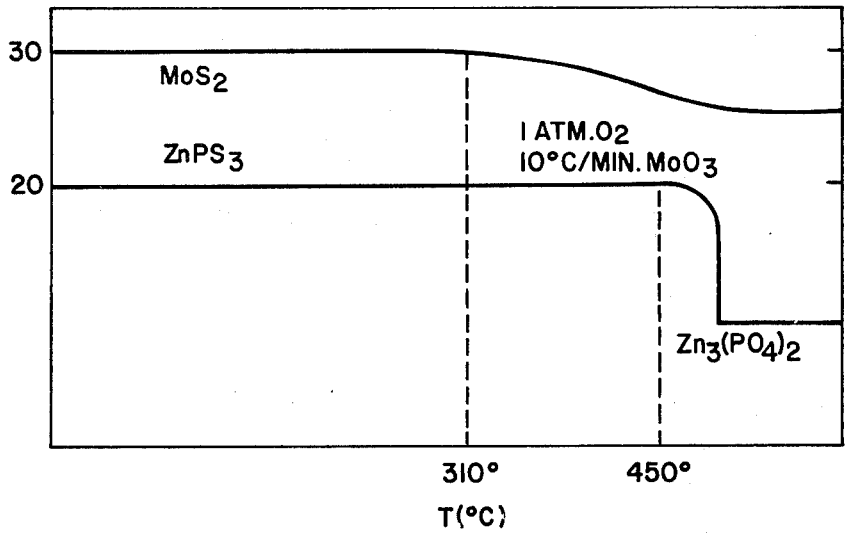

FIGURE II
BALL ON CLINDER DEVICE
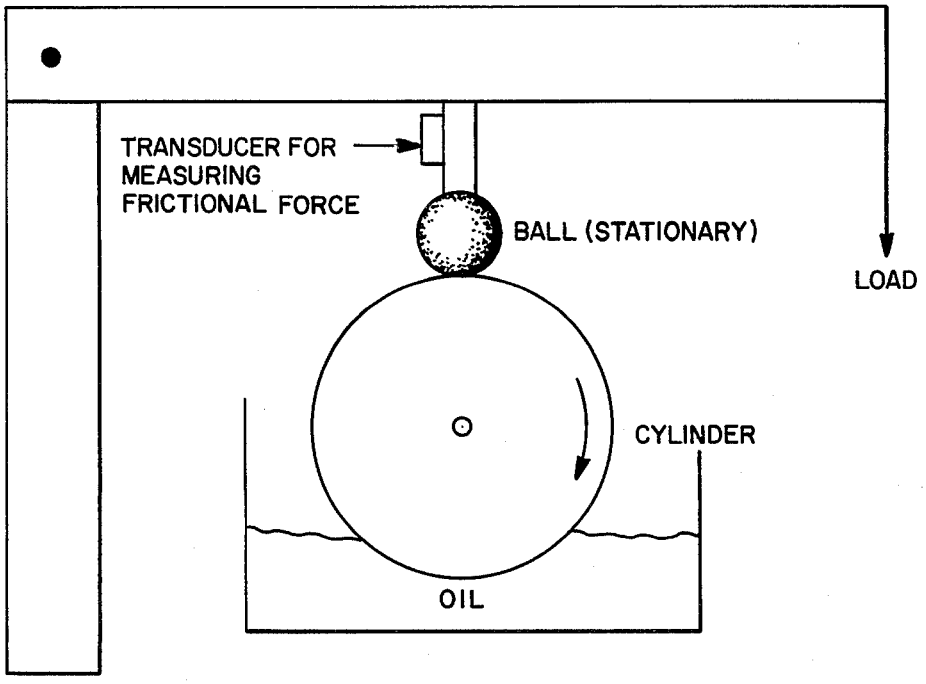

FIGURE III
$ZnPS_3$ REDUCES FRICTION AND EXTENDS WEAR LIFE
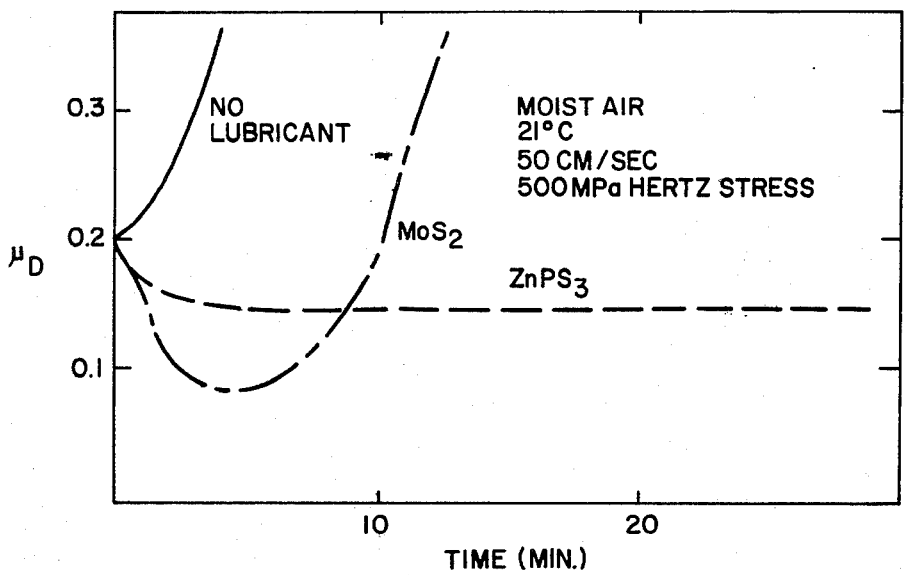

FIGURE IV
CYLINDER WEAR SCAR PROFILE FOR BASE OIL AND BASE OIL + $ZnPS_3$ BURNISHING
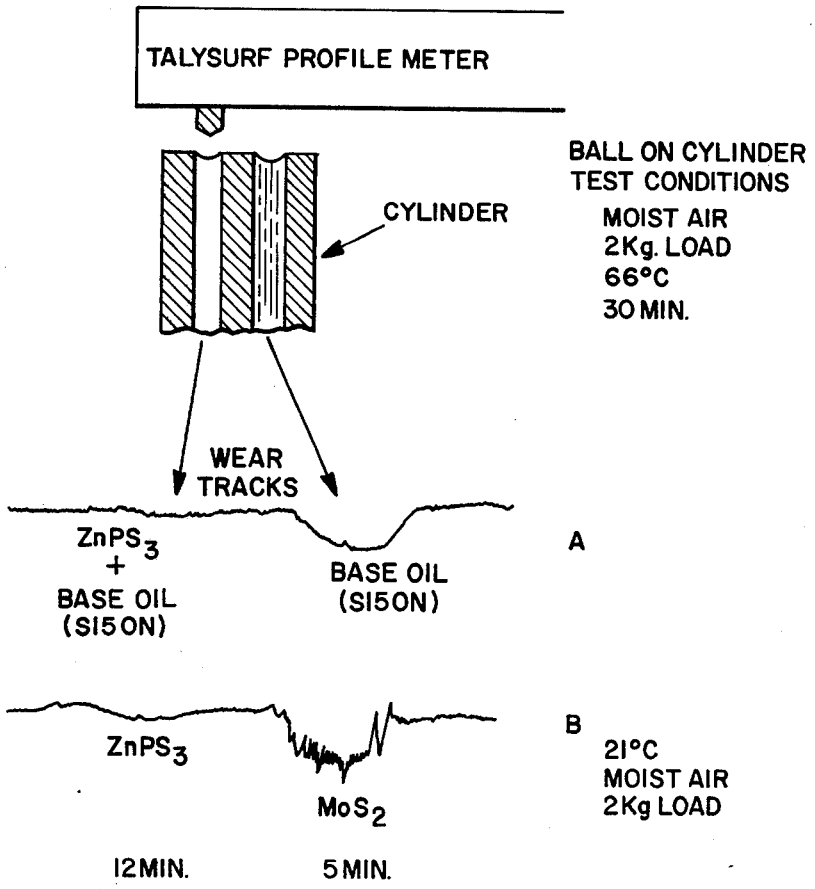

FIGURE V
COEFFICIENT OF FRICTION VS TIME FOR JOURNAL BEARING BURNISHED WITH $ZnPS_3$
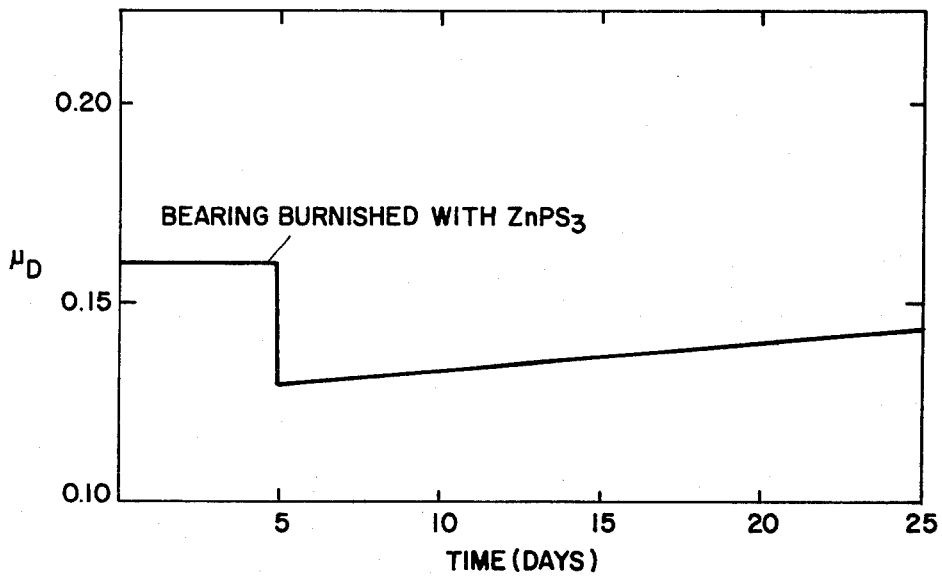

$MXY_3$ SOLID LUBRICANTS

CROSS REFERENCE TO RELATED APPLICATIONS

This application is a continuation-in-part of Case C-674, Ser. No. 870,033 filed Jan. 16, 1978, now abandoned, which is a Rule 60 continuation of Ser. No. 788,686 filed Apr. 18, 1977 now abandoned.

BRIEF DESCRIPTION OF THE INVENTION

It has been discovered and forms the basis of this disclosure that materials of the formula $MXY_3$ wherein M is selected from the group consisting of Mg, V, Mn, Fe, Co, Ni, Zn, Cd, Sn, Pb and mixtures thereof, preferably Fe, Zn and mixtures thereof, most preferably Zn, X is a pnictide selected from the group consisting of phosphorus, arsenic, antimony, and mixtures thereof, preferably phosphorus, arsenic and mixtures thereof, most preferably phosphorus and Y is a chalcogenide selected from the group consisting of sulfur, selenium, and mixtures thereof, most preferably sulfur are superior lubricants exhibiting; resistance to oxidation and thermal degradation, low friction, excellent antiwear activity and long effective life. Surfaces coated with these compositions resist gauling and damage due to adhesive or corrosive wear. As lubricants they can be used either dry or in conjuction with conventional lubricants selected from the group consisting of lubricating oils and greases.

BACKGROUND OF THE INVENTION

S. Soled and A. Wold in "Crystal Growth and Characterization of $In_{2/3}PS_3$", *Mat. Res. Bull.* Vol. 11, pg. 657–662, 1976, Pergamon Press, Inc., discuss in their introduction a number of mixed anion rich compounds of metal, pnictide and chalcogenides. They report the work of W. Klingen, *Dissertation*, Universitat Hohenheim, Germany, 1969, dealing with the crystal growth of the compounds $M^{II}PX_3$ (with M = Fe, Co, Ni, Zn, Mn, Cd, Sn, Hg or Pb; X = S or Se) by means of chemical vapor transport. They go on to indicate that these materials are structurally related to the layer compounds $CdI_2$ and $CdCl_2$ and contain close packed sulfur layers with every other interlayer filled with an ordered arrangement of metal atoms and sigma-bonded phosphorus-phosphorus pairs. The metal atoms are located in octahedral interstices and each phosphorus atoms is bonded in a distorted tetrahedron to three sulfur and one phosphorus atom. Because of the large anion-anion interlayers that remain empty (with a typical sulfur-sulfur interplanar distance of 3.4 A), these compounds exhibit easy cleavage parallel to the crystal faces and exhibit lubricity.

It was not recognized, however, that such material possesses and retains this lubrication capability under oxidizing conditions at relatively high temperatures and perform satisfactorily over periods of time which greatly exceed the operational times of conventional lubricants such as $MoS_2$.

In SLE Transactions, 14, 62, (1970) by Jamison and Cosgrove, the lubricating characteristics of a number of layered transition metal disulfides and diselenides were measured. The coefficient of friction was determined using a ball on flat type test apparatus loaded to 250g force. The static wear member was a ⅜ inch steel sphere. The lubricants were hand burnished onto a brass disc which acted as the dynamic wear member.

For the layered transition metal compounds which were studied, three types of lubricating behavior were observed. Some materials did not form adherent films; others did form films but could not support a sliding load; yet others formed films which could support heavy sliding loads. Table I summarizes the results. This clearly demonstrates that not all layered materials and more particularly not all layered sulfides are effective as solid lubricants.

TABLE I

STRUCTURE AND LUBRICATING PROPERTIES OF A NUMBER OF LAYERED TRANSITION METAL SULFIDES AND SELENIDES

| Composition | Structure | Coefficient of Dynamic Friction (250 g Load) |
|---|---|---|
| $ZrS_2$ | 1T | No Film[a] |
| $ZrSe_2$ | 1T | No Film[a] |
| $NbS_2$ | 3R | No Film[a] |
| $NbS_2$ | 2H | No Film[a] |
| $NbS_2$ | 3R | No Film[a] |
| $NbSe_2$ | 2H | 0.075 |
| $NbSe_2$ | 2H | 0.058 |
| $MoS_2$ | 2H | 0.045 |
| $MoS_2$ | 2H | 0.040 |
| $MoSe_2$ | 2H | 0.057 |
| $HfS_2$ | 1T | No Film[a] |
| $HfSe_2$ | 1T | No Film[a] |
| $TaS_2$ | 4H | Failed[b] |
| $TaS_2$ | 3R | No Film[a] |
| $TaSe_2$ | 2H | Failed[b] |
| $WS_2$ | 2H | 0.051 |
| $WS_2$ | 2H | 0.053 |
| $WSe_2$ | 2H | 0.047 |
| $WSe_2$ | 1T | No Film[a] |
| $WSe_2$ | 2H | 0.037 |
| $ReS_2$ | 3R | Failed[b] |
| $ReSe_2$ | Dist. 1T | Failed[b] |

[a]No lubricant film could be formed. [b]Lubricant film broke down before reaching this load.

THE INVENTION

Lubrication under a variety of conditions, i.e. oxidizing, reducing and inert atmosphere at temperatures up to about 450° C., preferably from about 310° C. to about 450° C., more preferably from about 400° C. to about 450° C., most preferably from about 21° C. to about 450° C., can be achieved by utilizing materials of the formula $MXY_3$, wherein M is selected from the group consisting of Mg, V, Mn, Fe, Co, Ni, Zn, Cd, Sn, Pb and di and poly mixtures thereof, preferably Fe, Zn and mixtures thereof, most preferably Zn, X is a pnictide selected from the group consisting of phosphorus, arsenic, antimony, and mixtures thereof, preferably phosphorus, arsenic and mixtures thereof, most preferably phosphorus, and Y is a chalcogenide selected from the group consisting of sulfur, selenium and mixtures thereof, most preferably sulfur.

By using such materials, wear can be greatly reduced since the lubricant resists breakdown due to atmosphere and temperature conditions particularly oxidation and high temperature decomposition. Consequently, these materials are superior lubricants to those known in the art such as $MoS_2$ which deteriorate in oxidizing atmospheres at relatively low temperatures. Materials which thus deteriorate ultimately permit high friction and damage to the surfaces they were meant to protect, the damage being recognized as increased wear, gauling, abrasion, scoring, corrosion, etc.

The materials $MXY_3$, wherein M, X and Y are as previously defined, which function as lubricants are prepared by any number of methods known in the art. For example, the lubricating materials can be prepared by the direct reaction of the elements in evacuated sealed silica tube resulting in the formation of polycrystalline materials.

Materials of the formula $MXY_3$ wherein M, X and Y are as previously defined, exhibit remarkable stability at temperatures up to 450° C., preferably 400°–450° C., more preferably 310°–450° C., most preferably 21°–450° C., under a variety of conditions ranging from reducing to inert to oxidizing, preferably oxidizing. It is the stability of the materials at elevated temperatures under oxidizing conditions and high load which makes them outstanding lubricants.

The materials useful in the instant invention may be of the general formula $MXY_3$ wherein M, X and Y are as previously defined. Further, they may be di- or poly mixed cation or anion solid solutions, that is, the material may include more than one metal and/or more than one chalcogenide, for example

| | |
|---|---|
| $Zn_{1-q}Fe_qPS_3$ | $0 \leqq q \leqq 1$ |
| $FePSe_{3-Z}S_Z$ | $0 \leqq Z \leqq 3$ |
| $Zn_{1-q}Fe_qPSe_{3-Z}S_Z$ | $0 \leqq q \leqq 1$ |
| | $0 \leqq Z \leqq 3$ |

Such mixed metal and/or mixed chalcogenide materials are included within the scope of the invention as they also exhibit resistance to deterioration under a variety of atmosphere and temperature conditions, particularly oxidizing conditions at high temperatures under load and consequently lubricate at surface-surface interfaces. In general, preferred materials of the instant invention are $ZnPS_3$, $FePS_3$, and $PbPS_3$.

The $MXY_3$ materials of the instant invention can be used either as dry lubricants themselves or as additives to oils and greases. The $MXY_3$ materials can be added to lubricating greases in any number of ways. Direct addition (suspension) of finely divided $MXY_3$ is one alternative while another is the suspension in lubricating oils of $MXY_3$ materials which have been reduced to a fine particle size by chemical or mechanical means. Briefly, this last mentioned technique involves dispersing the $MXY_3$ material in a suitable media such as a small volume of natural or synthetic oils to which has been preferably added a small amount of a surface active dispersing agent. This is then added to the lubricating oil as an additive in suspension. The grease or lubricant material resulting from the addition of the $MXY_3$ type material contains from 0.1% to 20 wt. % $MXY_3$ type material, preferably 1–5 wt. %, the balance being lubricating oil or grease.

Included are greases wherein lubricating oil is thickened with salts, soaps, soap-salt or mixed salt complexes, polymeric thickeners (e.g. polymers of $C_2$ to $C_4$ monoolefins of 10,000 to 200,000 Staudinger molecular weight such as polyethylene) and inorganic thickeners (e.g. clay, carbon black, silica gel, etc.). However, the method of the invention is of particular value in cases where the grease is thickened with a metal soap other than sodium, and particularly where the metal is polyvalent metal acids of an alkaline earth metal such as calcium, or aluminum.

Generally, the greases will comprise a major amount of either a synthetic or natural lubricating oil, thickened with about 3 to 49 wt. percent, usually 20 to 45 wt. percent, of a thickener. In the case of soap-salt and mixed-salt thickeners, the thickener is usually formed by coneutralization in oil, by metal base, while heating to dehydrate or remove alcohol (if an alcoholate is used in the metal base) of various mixtures of high molecular weight carboxylic acids, e.g. fatty acids and/or intermediate molecular weight carboxylic acids, e.g. fatty or aromatic acids, with low molecular weight carboxylic, e.g. fatty acids.

The high molecular weight carboxylic acids useful for forming soap, soap-salt and mixed-salt thickeners include naturally-occurring or synthetic substituted and unsubstituted saturated and unsaturated, mixed or unmixed fatty acids having about 14 to 30, e.g., 16 to 22, carbon atoms per molecule. Examples of such acids include stearic, hydroxy stearic, such as 12-hydroxy stearic, dihydroxy stearic, polyhydroxy stearic and other saturated hydroxy fatty acids, arachidic, oleic, ricinoleic, hydrogenated fish oil, tallow acids, etc.

Intermediate molecular weight carboxylic fatty acids include those aliphatic, aromatic, alkaryl, etc., saturated, unsubstituted monocarboxylic acids containing 7 to 12 carbon atoms per molecule, e.g., capric, lauric, caprylic, nonanoic, benzoic acid, etc.

Low molecular weight fatty acids include saturated and unsaturated, substituted and unsubstituted, aliphatic carboxylic acids having about 1 to 6 carbon atoms. These acids include fatty acids such as formic, acetic, propionic, etc. Acetic acid or its anhydride is preferred.

Metal bases which are frequently used to neutralize the above acids are the hydroxides, oxides, carbonates or alcoholates of alkali metals (e.g. lithium and sodium) or of alkaline earth metals (e.g., calcium, magnesium, strontium and barium) or other polyvalent metals commonly used in grease making, e.g. aluminum.

Various other additives may also be added to the lubricating composition (e.g. 0.1 to 10.0 wt. percent based on the total weight of the composition) for example, oxidation inhibitors such as phenyl-alpha-naphthylamine; tackiness agents such as polyisobutylene; stabilizers such as aluminum hydroxy stearate; and the like.

The lubricating oil employed as such or to produce lubricating grease compositions in the method of this invention may be conventional natural oils as well as synthetic lubricating oils, although the mineral lubricating oils are preferred. The synthetic oils include synthetic lubricating oils having a viscosity of at least 30 SSU at 100° F. such as esters of monobasic acids (e.g. ester of $C_3$ Oxo alcohol with $C_8$ Oxo acid, ester of $C_{13}$ Oxo alcohol with octanoic acid, etc.) esters of dibasic acids (e.g. di-2-ethyl hexyl sebacate, dinonyl adipate, etc.) esters of glycols (e.g. $C_{13}$ Oxo acid diester of tetraethylene glycol, etc.) complex esters (e.g. the complex ester formed by reacting 1 mole of sebacic acid with 2 moles of tetraethylene glycol and 2 moles of 2-ethyl hexanoic acid, complex ester formed by reacting 1 mole of tetraethylene glycol with 2 moles of sebacic acid and 2 moles of 2-ethylhexanol, complex ester formed by reacting together 1 mole of azelaic acid, 1 mole of tetraethylene glycol, 1 mole of $C_8$ Oxo alcohol, and 1 mole of $C_8$ Oxo acid), esters of phosphoric acid (e.g., the ester formed by contacting 3 moles of the monomethyl ether of ethylene glycol with 1 mole of phosphorus oxychloride, etc.), halocarbon oils (e.g. the polymer of chlorotrifluoroethylene containing 12 recurring units of chlorotrifluoroethylene), alkyl silicates (e.g. methyl polysilixanes, ethyl polysiloxanes, methyl phenyl polysiloxanes, ethyl phenyl polysiloxanes, etc.), sulfite esters (e.g. ester formed by reacting 1 mole of sulfur oxychloride with 2 moles of the methyl ether of ethylene glycol, etc.), carbonates (e.g. the carbonate formed by reacting $C_8$ Oxo alcohol with ethyl carbonate to form a half ester and reacting this half ester with tetraethylene glycol), mercaptals (e.g., the mercaptal formed by reacting 2-ethyl hexyl mercaptan with formaldehyde), formals (e.g., the formal formed by reacting $C_{13}$ Oxo alcohol with formaldehyde), polyglycol type synthetic oils (e.g., the compounds formed by condensing butyl alcohol with 14 units of propylene oxide, etc.), or mixtures of any of the above in any proportions. Quite generally the mineral or synthetic oils should have a viscosity within the range of about 35 to 200 SSU at 210° F. and flash points of about 350° to 600° F. Lubricating oils having a viscosity index of 100 or higher may be employed.

EXAMPLES

Typical $MXY_3$ compositions were studied under differing conditions so as to define the limits of their applicability. They were subjected to high temperatures under inert, oxidizing and reducing atmosphere and the point of deterioration (T min) was determined from thermal gravimetric experiments. X-ray analysis was used to identify the end product.

A. Thermal Decomposition $$ZnPS_3 \xrightarrow[1000^\circ C]{Ar} X_o(\text{-}ZnS + Y\beta\text{-}ZnS + 1/4\ P_4S_7\uparrow + 1/4\ S\uparrow$$
$$(X + Y = 1) \qquad T_{min.} = 450^\circ C$$

$$FePS_3 \xrightarrow[1000^\circ C]{Ar} FeS + 1/4\ P_4S_7\uparrow + 1/4\ S\uparrow$$
$$T_{min.} = 590^\circ C$$

B. Oxidation $$3ZnPS_3 + 31/2\ O_2 \xrightarrow[1000^\circ C]{} \beta\text{-}Zn_3(PO_4)_2 + 9SO_2\uparrow + P_2O_5\uparrow$$
$$T_{min.} = 450^\circ C.$$

$$FePS_3 + 5O_2 \xrightarrow[1000^\circ C]{} FePO_4 + 3SO_2\uparrow$$
$$T_{min.} = 490^\circ C$$

$$MoS_2 + 7/2\ O_2 \longrightarrow MoO_3 + 2SO_2\uparrow$$
$$T_{min.} = 310^\circ C$$

C. Reduction $$ZnPS_3 + 9/2\ H_2 \xrightarrow[700^\circ C]{} X_o(\text{-}ZnS + Y\beta\text{-}ZnS + 3H_2S + PH_3\uparrow$$
$$(x + y = 1) \qquad T_{min.} = 450^\circ C$$

$$FePS_3 + 7/2\ H_2 \xrightarrow[1000^\circ C]{} FeS + 3H_2S\uparrow + PH_3\uparrow$$
$$T_{min.} = 540^\circ C$$

FIG. 1 shows the thermogravimetric trace for the oxidation of $ZnPS_3$ and $MoS_2$. Reports in the literature show a significant increase in the coefficient of friction for $MoS_2$ at high temperatures which correlates with the onset of oxidation. The increased stability of $ZnPS_3$ ($T_{min}$ = 450° C.) and $FePS_3$ ($T_{min}$ = 490° C.) relative to $MoS_2$ ($T_{min}$ = 310° C.) under this realistic (oxidizing) condition demonstrates its superiority as a lubricant in real life situations.

In addition to the chemical stability of the $MPS_3$ phases at elevated temperatures, their compatibility with other chemicals has also been tested. These materials are stable to dissolution in $H_2O$, $CS_2$, and hydrocarbons such as pentane, heptane, cyclohexane, benzene, xylene and toluene. In addition, other organics such as methanol, ethanol, diethyl ether, acetone and trichloromethane neither reacted with nor dissolve $ZnPS_3$ or $FePS_3$. However, $ZnPS_3$ and $FePS_3$ react with strong acids and bases (i.e. HCl, $HNO_3$, $CH_3COOH$, KOH, NaOH). The $MPS_3$ phases also react with Lewis bases such as ammonia and pyridine.

The stability of the $MPS_3$ phases in solvents, particularly hydrocarbons, is an important feature necessary for the synthesis of lubricating oil and grease dispersions and goes to enhance the desirability of these $MXY_3$ compounds as additives.

Tests of $ZnPS_3$ as a dry lubricant under various conditions (atmosphere-inert or oxidizing and dry or moist; sliding speed-5 to 50 cm/sec; and load 100 MPa to 750 MPa Hertz Stress) have been conducted using the ball-on-cylinder device.

FIG. II is a schematic of the ball on cylinder device which consists basically of a stationary ball which is loaded onto a rotating cylinder. A dead weight load is applied to the end of a lever system which in turn loads the ball (52100 steel, $R_c$ 20 to 22) onto the cylinder (52100 steel, $R_c$ 60 to 62) with a calcuable initial Hertzian Stress. Through the use of a variable speed motor, the cylinder can be rotated to obtain various sliding velocities. The test device is equipped with a transducer for recording the frictional force. Additional flexibility is available by enclosing the device in a gas tight enclosure which allows various blanketing atmospheres to be investigated. The test lubricant was burnished onto a precleaned (50% xylene/50 methanol) cylinder from a degreased lint-free cloth which was loaded with excess material. The cloth containing the lubricant was pressed onto the cylinder under specified conditions of load rotation speed and time (200 g force, 200 RPMs and 15 min.). In this way reproducible films could be achieved.

FIG. III shows typical results obtained using "realistic" conditions (moist air, 50 cm/sec sliding speed and 500 MPa Hertz Stress). The initial low friction recorded for the nonlubricated case can be attributed to the existence of an oxide surface film. The rapid increase and eventual failure corresponds to a progressive removal of the surface oxide. Optical investigation of the wear surface after failure with no solid lubricant reveals a severely gauled area confirming an adhesive type wear mechanism. The fall off of the coefficient of friction for both $MoS_2$ and $ZnPS_3$ in the initial portion of the test is similar to that observed for other lamellar solid lubricants. This "induction" or "run-in" period can be attributed to an alignment of the crystallites on the wear surface. It is clear from this data that the friction reduction obtained using $MoS_2$ is better than that found for $ZnPS_3$. However, the effective lifetime of the $MoS_2$ film is significantly less than that observed for $ZnPS_3$ burnishing.

In addition to recording the frictional character and effective life, an assessment of the wear damage can be made using a surface profilometer. FIG. IV reproduces the surface profiles for several tests. From cylinders burnished with $ZnPS_3$ and run in the presence of a base oil (Solvent 150N), a significant reduction in wear can be noted relative to the base oil case, (FIG. IVa). In addition, comparisons of wear tracks for areas burnished with $ZnPS_3$ relative to $MoS_2$, which were terminated before failure, also reveals a significant reduction in wear (FIG. IVb). Optical examination of the wear tracks generated for $ZnPS_3$ and $MoS_2$ burnished areas confirm reduced wear. The $MoS_2$ lubricated track is severely gauled and pitted. The $ZnPS_3$ track is smooth and shows little or no evidence of gauling.

In addition to the ball on cylinder tests, the more common four ball test was also made. For these tests, the precleaned 52100 steel balls were burnished by rolling in excess solid lubricant for 1 hour at 20 revolutions per minute. An evaluation of the wear was made by optically measuring the wear scar diameter (WSD) generated on the three stationary balls.

Table II records the data for the cases of no lubricant, and for $MoS_2$ and $ZnPS_3$ treats. For both $MoS_2$ and $ZnPS_3$ a reduction in wear relative to an unlubricated case can be noted. For the lubricated tests, the presence of an oxidizing atmosphere degrades the antiwear activity. A significant increase in wear is observed in going from inert to oxidizing atmosphere for $MoS_2$ treats. Similar behavior is observed for the $ZnPS_3$ burnished areas, however, the increase in wear is much less than that found for $MoS_2$ treated balls.

FIG. V shows the results obtained using the journal bearing test device. The application of $ZnPS_3$, by burnishing on a run-in journal, resulted in reduction of the friction coefficient. The initial coefficient dropped by 20% and then slowly increased over a period of 25 days. This particular test was conducted in the presence of and in conjunction with a base oil and confirmed the initial work done on the ball-on-cylinder device which showed a similar reduction of friction and increased anti-wear activity.

TABLE II

FOUR BALL PERFORMANCE OF DRY LUBRICATED SYSTEMS

| | Wear Behavior | | | |
|---|---|---|---|---|
| | Inert | | Air | |
| Lubricant | WSD[1] (mm) | V[2] ($mm^3$) | WSD (mm) | V ($mm^3$) |
| None | 1.30 | $2.2 \times 10^{-1}$ | 1.18 | $1.5 \times 10^{-1}$ |
| $MoS_2$ | 0.04 | $2.0 \times 10^{-3}$ | 1.00 | $7.7 \times 10^{-2}$ |
| $ZnPS_3$ | 0.41 | $2.2 \times 10^{-3}$ | 0.73 | $2.2 \times 10^{-2}$ |

Test Conditions: 600 RPM, 15 min., 1440 MPa Hertz Stress, 21° C, 52,100 steel.
[1]WSD - Average Wear Scar Diameter of three stationary members.
[2]V - Wear Volume.
NOTE: The wear rate can be obtained by dividing the wear volume by 15 minutes.

EXAMPLE 4g of $ZnPS_3$, $FePS_3$ and $MoS_2$ were added to 96g of an aluminum complex soap-salt grease made from the following components:

90 g: Animal Fatty Acid
30 g: Benzoic Acid
50 g: Kolate (aluminum alcoholate, isopropyl)
1742 g: Coray 80/50 (unextracted naphthenic mineral lubricating oil)
6 g: UOP 225 (commercial anti-oxidant)

The grease was prepared by heating the mixture of acids and alcoholate in the oil, with the removal of methyl alcohol, to form the complex of the aluminum with the fatty acid and benzoic acid, and adding the anti-oxidant. The test materials, i.e. the $ZnPS_3$, $FePS_3$, and $MoS_2$ were mixed into the grease components at room temperature and the resulting formulations were milled so as to uniformly mix the solid components into the grease. In addition, two standard extreme pressure formulations, base grease + 2% Elco 114 (zinc dialkyl dithiophosphate) and base grease + 3% tricalcium phosphate + 1% sulfurized polybutene were formulated and milled. Each grease formulation was subsequently tested for extreme pressure properties following the reapproved 1974 ASTM procedure for "Measurement of Extreme-pressure properties of lubricating greases"0 (Four Ball Method) (Designation D 2596-69). For the base grease and for each formulation the wear scar diameter (mm) was measured as a function of the applied load (Kg). The last non-seizure load and the weld point were recorded and the standard load wear index was calculated. Table III shows the results for these tests.

TABLE III

RESULTS OF FOUR BALL EXTREME PRESSURE TESTS (ASTM D 2596-69)

| Sample Description | Load Wear Index |
|---|---|
| Base Grease | 20 |
| Base Grease + 2% Elco 114 | 25 |
| Base Grease + 3% Tricalciumphosphate 1% Sulfurized polybutene | 33 |
| Base Grease + 4% $MoS_2$ | 37 |
| Base Grease + 4% $FePS_3$ | 39 |
| Base Grease + 4% $ZnPS_3$ | 44 |

From this data we see that addition of $ZnPS_3$ or $FePS_3$ to an aluminum complex soap grease improves the extreme pressure characteristics relative to the base grease and also with respect to standard extreme pressure formulations. In addition the performance of the grease with 4% $ZnPS_3$ or $FePS_3$ is superior to that found for a grease formulated with an equivalent amount of the well-known solid lubricant $MoS_2$.

EXAMPLE $ZnPS_3$ was added 4%, 2% and 1% by weight to an aluminum complex soap grease, prepared in the manner previously described and formulated as:

45.1 g: Animal Fatty Acid
15.0 g: Benzoic Acid
25.0 g: Kolate (aluminum alcoholate-isopropyl)
3.0 g: UOP 225 (standard anti-oxidant)
871.0 g: Coray 80/50 (unextracted naphthenic mineral lubricating oil)

The resulting grease formulations were milled to disperse the solids transition metal phosphorus trisulfide throughout the grease matrix. Each of these formulations along with the base grease were evaluated using the standard ASTM D 2596-69 and ASTM D 2509-73 test procedures. The load wear index and the Timken pass designation given in Table IV shows the effectiveness of $ZnPS_3$ as an extreme pressure additive even when this material is present as a 1% by weight additive. These greases were not compounded with finely divided particulates and are thus very crude test combinations.

TABLE IV

RESULTS OF EXTREME PRESSURE TEST FOR AN ALUMINUM COMPLEX SOAP GREASE-$ZnPS_3$ GREASE FORMULATIONS

| Sample Designation | Load Wear Index | Timkin (Pass/Fall) |
|---|---|---|
| Base Grease | 25.6 | Not Tested |
| Base Grease + 4% $ZnPS_3$ | 47.6 | Pass |
| Base Grease + 2% $ZnPS_3$ | 43.8 | Fail |
| Base Grease + 1% $ZnPS_3$ | 34.3 | Pass |

EXAMPLE $ZnPS_3$ was hand burnished onto a 1.5 in. diameter steel cylinder (AISI 52100 $R_c$ = 20 to 22). The cylinder was placed onto a shaft which allowed it to rotate creating a 50 cm/sec tangential velocity relative to a fixed ½ in. diameter steel ball (AISI 52100 $R_c$ = 60 to 62) (see FIG. II). The cylinder rotated in an oil (solvent 150 N mineral oil) filled trough which constantly wet its surface with a film of oil. The coefficient of dynamic friction between the cylinder and the ball was recorded for the 30 min. duration of the tests. No significant variation in the dynamic frictional coefficient ($\mu_D$ ranged from 0.10 to 0.12) was noted for the test run on the burnished area relative to the unburnished portion of the cylinder. However, a subsequent investigation of the wear scar profiles, FIG. IV, using a profilometer, showed a dramatic reduction in wear for the test run on the burnished area relative to the unburnished area.

What is claimed is:

1. A method for lubricating contacting surfaces which comprises using, as a lubricant, material of the formula $MXY_3$ wherein M is selected from the group consisting of Mg, V, Mn, Fe, Co, Ni, Zn, Cd, Sn, Pb and mixtures thereof, X is a pnictide selected from the group consisting of phosphorus, arsenic, antimony and mixtures thereof and Y is a chalcogenide selected from the group consisting of sulfur, selenium and mixtures thereof.

2. The method of claim 1 wherein X is phosphorus.

3. The method of claim 2 wherein Y is sulfur.

4. The method of claim 1 wherein M is Fe, Zn and mixtures thereof.

5. The method of claim 4 wherein X is phosphorus and Y is sulfur.

6. The method of claim 1 wherein the lubricant is $ZnPS_3$.

7. The method of claim 1 wherein the lubricant is $FePS_3$.

8. The method of claim 1 wherein the lubricant is $PbPS_3$.

9. The method of claim 1 wherein the contacting surfaces are lubricated at high temperatures.

10. The method of claim 9 wherein the high temperature above which lubrication is maintained is from about 310° C. to about 450° C.

11. The method of claim 9 wherein the high temperature above which lubrication is maintained is from about 400° C. to about 450° C.

12. The method of claim 1 wherein the contacting surfaces are lubricated at temperatures of from 21° C. to about 450° C.

13. The method of claim 1 wherein the contacting surfaces are contacted under oxidizing, reducing or inert atmosphere conditions.

14. The method of claim 13 wherein the contacting surfaces are contacted under oxidizing conditions.

15. The method of claim 14 wherein the contacting surfaces are contacted at temperatures ranging from about 310° C. to about 450° C.

16. The method of claim 14 wherein the contacting surfaces are contacted at temperatures ranging from about 400° C. to about 450° C.

17. The method of claim 15 wherein the lubricant is $ZnPS_3$.

18. The method of claim 15 wherein the lubricant is $FePS_3$.

19. The method of claim 15 wherein the lubricant is $PbPS_3$.

20. In methods for lubricating contacting surfaces using lubricants selected from the group consisting of lubricating oils and greases to which have been added additives, the improvement comprising using as an additive a lubricant material of the formula $MXY_3$ wherein M is selected from the group consisting of Mg, V, Mn, Fe, Co, Ni, Zn, Cd, Sn, Pb and mixtures thereof, X is a pnictide selected from the group consisting of phosphorus, arsenic, antimony and mixtures thereof and Y is a chalcogenide selected from the group consisting of sulfur, selenium and mixtures thereof.

21. The method of claim 20 wherein the lubricant additive, M is selected from the group consisting of Fe, Zn, Pb and mixtures thereof.

22. The method of claim 20 wherein in the lubricant additive X is phosphorus.

23. The method of claim 20 wherein in the lubricant additive Y is sulfur.

24. The method of claim 21 wherein in the lubricant additive X is phosphorus and Y is sulfur.

25. The method of claim 20 wherein the lubricant additive is $ZnPS_3$.

26. The method of claim 20 wherein the lubricant additive is $FePS_3$.

27. The method of claim 20 wherein the lubricant additive is $PbPS_3$.

28. The method of claim 20 wherein the lubricant additive is $Zn_{1-q}Fe_qPS_3$ wherein $0 \leqq q \leqq 1$.

29. A lubricant comprising a major amount of lubricating oil and about 0.1 to 20 wt. % of material of the formula $MXY_3$ wherein M is selected from the group consisting of Mg, V, Mn, Fe, Co, Ni, Zn, Cd, Sn, Pb and mixtures thereof, X is a pnictide selected from the group consisting of phosphorus, arsenic, antimony and mixtures thereof and Y is a chalcogenide selected from the group consisting of sulfur, selenium and mixtures thereof.

30. A lubricant according to claim 29, wherein said lubricant includes a grease thickening amount of a grease thickener.

31. A lubricant according to claim 30, wherein said grease thickener is a polyvalent metal salt of carboxylic acids.

32. A lubricant according to claim 31, wherein said grease thickener is an aluminum complex of $C_{14}$ to $C_{30}$ fatty acid and benzoic acid.

33. A lubricant according to claim 29, wherein said lubricant is a fluid composition wherein said material of said formula is dispersed therein.

34. A lubricant according to claim 30, wherein said material is $ZnPS_3$.

35. A lubricant according to claim 30, wherein said material is $FePS_3$.

36. A lubricant according to claim 33, wherein said material is $ZnPS_3$.

37. A lubricant according to claim 33, wherein said material is $FePS_3$.

* * * * *